United States Patent [19]

Rancour et al.

[11] Patent Number: 4,947,901

[45] Date of Patent: Aug. 14, 1990

[54] STRAP TENSIONING AND CUT OFF TOOL

[75] Inventors: James K. Rancour, St. Cloud; Lester N. Smith, Annandale, both of Minn.

[73] Assignee: Malco Products, Inc., Annandale, Minn.

[21] Appl. No.: 306,299

[22] Filed: Feb. 6, 1989

[51] Int. Cl.[5] ..... B21F 9/00

[52] U.S. Cl. ..... 140/93.2; 140/123.6

[58] Field of Search ..... 140/93 A, 93.2, 123.6

[56] References Cited

U.S. PATENT DOCUMENTS

| | | | |
|---|---|---|---|
| 3,154,114 | 10/1964 | Bailey | 140/10 |
| 3,168,119 | 2/1965 | Schwester et al. | 140/123.6 |
| 3,169,560 | 2/1965 | Caveney et al. | 140/123.6 |
| 3,173,456 | 3/1965 | Bailey | 140/123.6 |
| 3,254,680 | 6/1966 | Caveney et al. | 140/93.2 |
| 3,332,454 | 7/1967 | Lawson et al. | 140/93.2 |
| 3,344,815 | 10/1967 | Lawson | 140/123.6 |
| 3,433,275 | 3/1969 | Eppler | 140/93.2 |
| 3,515,178 | 6/1970 | Hidassy | 140/123.6 |
| 3,661,187 | 5/1972 | Caveney et al. | 140/123.6 |
| 3,782,426 | 1/1974 | Morgan et al. | 140/123.6 |
| 3,993,109 | 11/1976 | Fortsch | 140/123.6 |
| 4,202,384 | 5/1980 | Aubert | 140/123.6 |
| 4,733,701 | 3/1988 | Loisel et al. | 140/123.6 |

OTHER PUBLICATIONS

TY-RAP Cable Ties, Thomas & Betts Corporation.

*Primary Examiner*—Lowell A. Larson

*Attorney, Agent, or Firm*—Palmatier & Sjoquist

[57] ABSTRACT

The present invention is a tensioning and cut off tool for applying a strap having a locking collar and a free end to a bundle. It features a quick release operating mechanism that cuts the strap with a snap action in response to a certain level of tension that has been applied to the strap by the tool. It also features a resetting means for resetting the tool after the cutting action to a position where the tool can be used again. It further features a non-tension responsive cutting mechanism so that either the quick release tension related operating mechanism or the non-tension related mechanism may be selected to cut the strap.

13 Claims, 3 Drawing Sheets

STRAP TENSIONING AND CUT OFF TOOL

BACKGROUND OF THE INVENTION

The present invention relates to hand tools and more particularly to tensioning and cut off tools for binder straps with locking collars.

A strap tensioning and severing tool having a complicated operating mechanism is shown in the Caveney et al. U.S. Pat. No. 3,661,187 issued May 9, 1972, and assigned to Panduit Corporation of Tinley Park, Ill. It discloses a gripper mechanism which transmits force from an actuator link, to a drive link, to a lever link, to a tension rod on which the gripper is pivotally mounted. A severing mechanism transmits force from the actuator link, to the drive link, to the lever link, to a pair of link plates, and finally to a detent member which in turn allows the link plates to pivot from their normal position. The pivoting of the link plates causes a lever arm to pivot and raise a blade to sever a strap. The strap is severed between an abutment plate and the gripper.

SUMMARY OF THE INVENTION

A feature of the present invention is a strap tensioning and cut off tool having relatively swingable handles to produce the tensioning, and wherein one of the handles suddenly articulates with a snap action when a certain level of tension in the strap is exceeded, to cause a blade to be propelled with a snap action and cut off the strap.

Another feature of the invention is a strap tensioning and cut off tool wherein relatively swingable handles are squeezed together to sequentially produce tensioning of the strap, cutting with a snap action when a certain tension in the strap is exceeded, and resetting of the tool as the handles are released for the next strap tensioning and cut off operation.

Still another feature of the invention is a strap tension and cut off tool having selectable mechanisms for producing cutting of the strap, one of which is tension responsive and related to the tension applied to the strap, and the other of which is non-tension responsive and may be operated without regard to the tension being applied to the strap.

An advantage of the present invention is that it provides for rapid operation. The handles may be rapidly squeezed together continuously until one of the handles suddenly articulates with the predetermined tension related break away to cut off the strap.

Another advantage of the present invention is that it provides consistent results. The tension related break away is predetermined. Hence each strap is tightened to substantially the same degree of tension.

Still another advantage of the present invention is that it is suitable for strapping either hard goods or soft, deformable goods. With hard goods, the articulating handle may be utilized. With soft goods which would deform if strapped tightly, the separate cut off handle may be used.

Still another advantage of the present invention is that the free end of the strap is severed so that it lies substantially flush with the locking collar. The cut off blade slides between the abutment and the locking collar to sever the free end of the strap so that its severed end lies substantially adjacent to an end of the locking collar.

Still another advantage of the present invention is that the gripper is mounted directly on the main handle. The main handle moves in a pivoting relationship with the support arm but includes no moving parts with which the gripper interacts.

DETAILED DESCRIPTION oF THE PREFERRED EMBODIMENT

Figure 1:
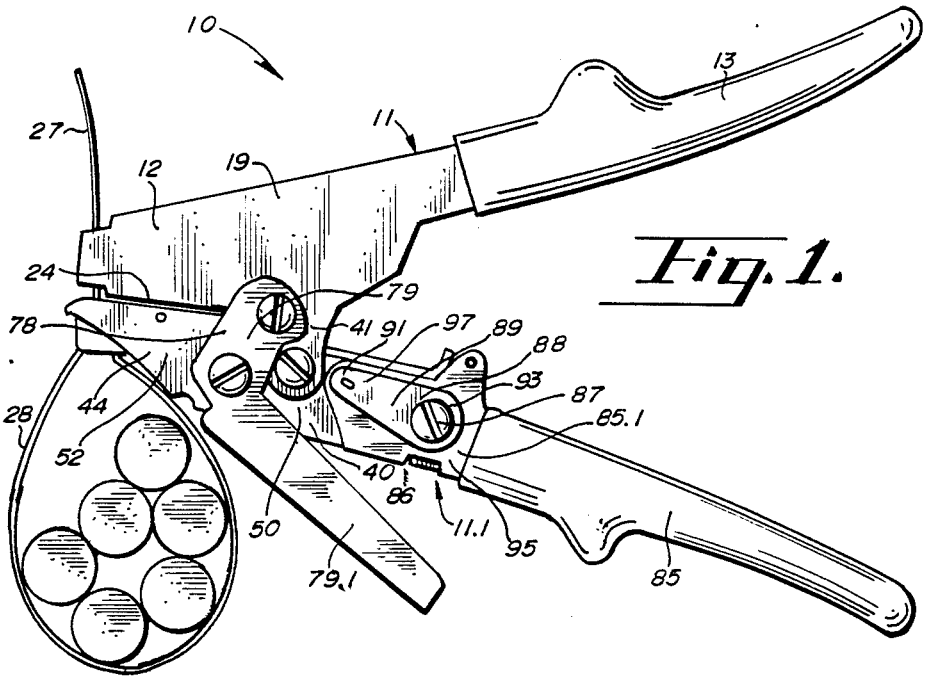
FIG. 1 shows a front elevation view of the tensioning and cut off tool applying a strap to a bundle.
Figure 2:
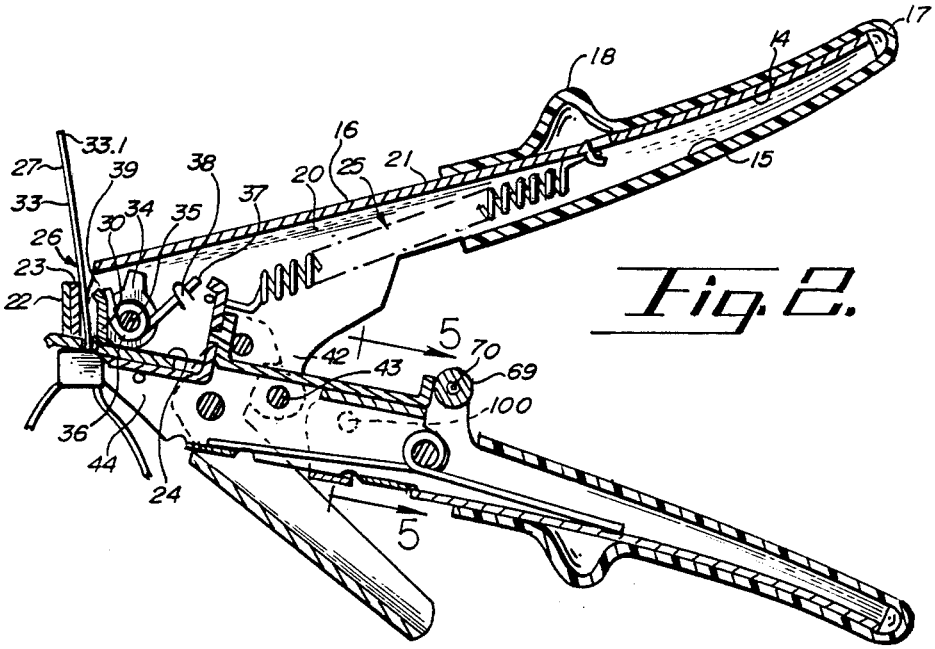
FIG. 2 shows a section view of the tool of FIG. 1.
Figure 7:
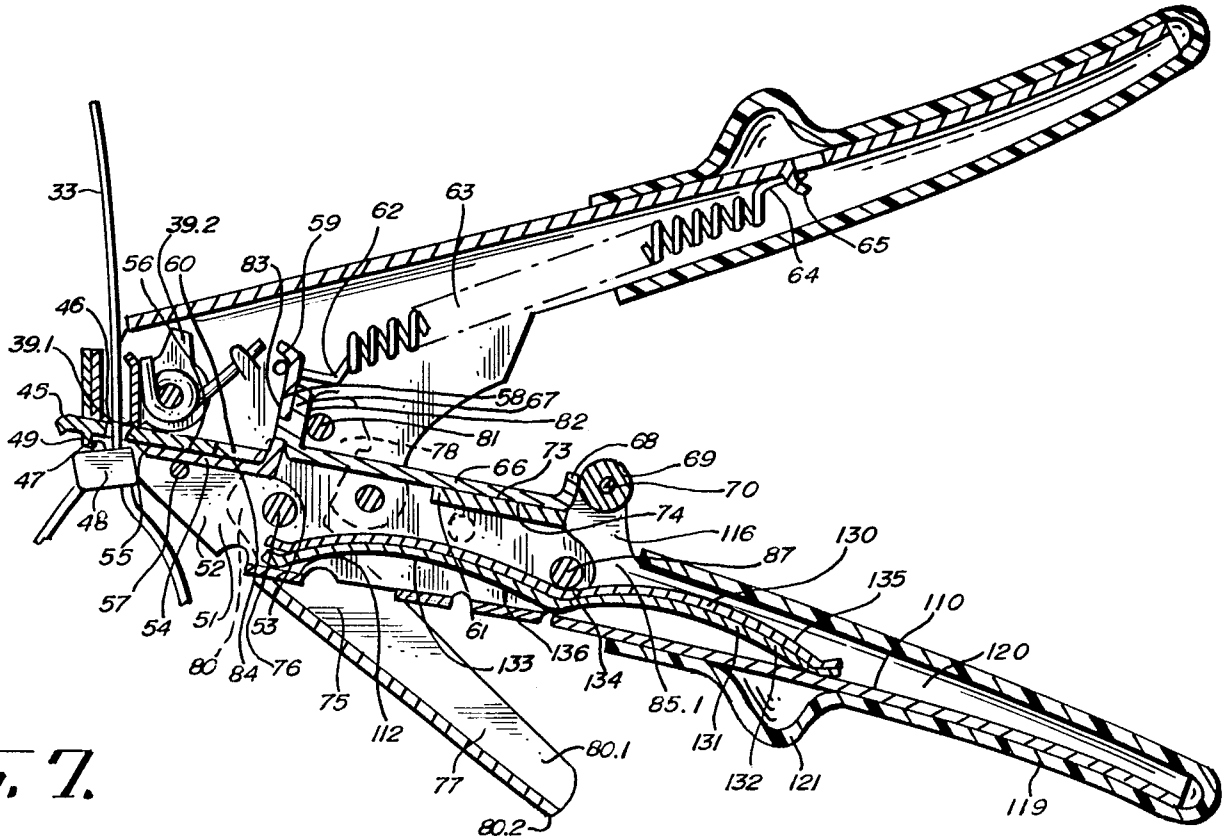
FIG. 7 is an enlarged view of FIG. 2 and includes an alternate resetting means.

As shown in FIGS. 1, 2, and 7, a tensioning and cut off tool 10 has a pair of handles 11 and 11.1. Handle 11 has a front end 12 and a rear end 13. The rear end 13 tapers slightly from front end 12 and has a pair of respective outer and inner, opposing, tapering edges 14 and 15 which extend in a curvilinear fashion outwardly from a substantially straight edge 16 of the front end 12. Rear end 13 includes a rubberlike or plastic like grip 17 covering about half of the main handle 11. Grip 17 has a protrusion or bump 18 to assist in a manual gripping of main handle 11.

The front end 12 of the main handle 11 has a pair of opposing parallel plates 19 and 20, a side plate 21, and a pair of end plates 22 and 23. Opposing plates 19 and 20 each have an inner abutting edge 24. Opposing plates 19 and 20 are formed similarly. Side plate 21 integrally connects opposing plates 19 and 20. The plates 19, 20, 21, 22, and 23 form a cavity 25 in the front end 12. A lateral slot 26 for receiving a free end 27 of a binder strap 28 is formed by side plate 21, end plate 23, opposing plates 19 and 20, and a gripper 30.

The gripper 30 for engaging and gripping the free end 27 of the strap 28 is mounted in the cavity 25 of the front end 12. The gripper 30 includes a guide 31 partially forming the slot 26 to guide the free end 27 entering slot 26. An oblique gripping tooth 32 is integrally connected to guide 31 for engaging a ridge face 33 or a smooth face 33.1 of the free end 27 of the strap 28. The tooth 32 is disposed obliquely and outwardly from guide 31. A base 34 of the gripper 30 is integrally connected to the guide 31 and forms an aperture for receiving a connector pin 35. Connector pin 35 pivotally connects the gripper 30 to the opposing plates 19 and 20 of the main handle 11. A torsion spring 36 is mounted about the connector pin 35. A pinched end 37 of the spring 36 is pinched by a pinching cut away section 38 of plate 20. A biased end 39 of the torsion spring 36 is urged continuously against the engaging tooth 32 in the direction of end plates 22 and 23.

The gripper 30 includes a front end 39.1 and an extension arm 39.2 integrally connected to the base 34. The front end 39.1 is continuously urged by the torsion spring 36 in a direction away from edge 16 of the handle 11. The extension arm 39.2 is continuously urged in a direction toward edge 16 and bears against edge 16 when no binder strap 27 exists in the binder slot 26. The extension arm 39.2 precludes the gripper 30 from being pushed out of the handle 11 by the torsion spring 36.

Figure 4:
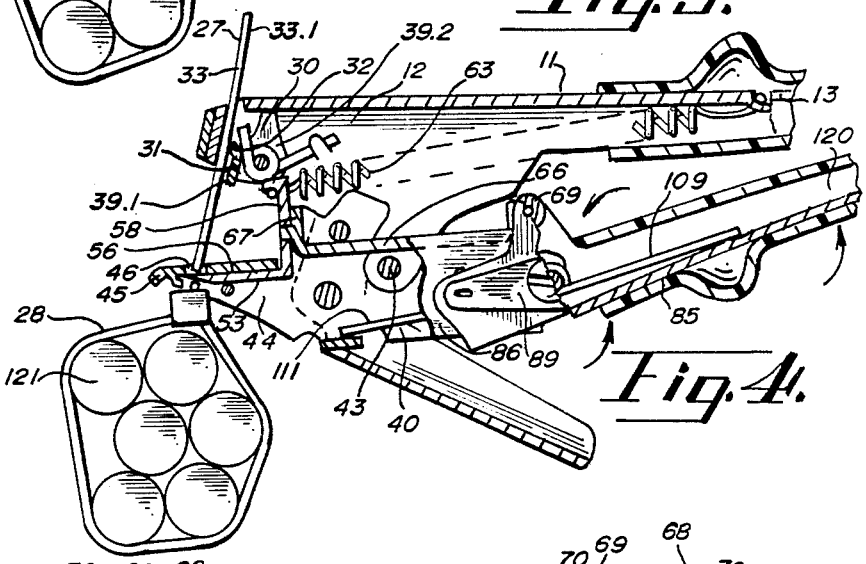
FIG. 4 shows the section view of FIG. 2 with a tensioning handle propelling the blade to cut the strap.

As shown in FIGS. 1 and 4, the second handle 11.1 is articulated and includes as its principal components a support arm 40 and a tensioning handle or pressure or break away lever 85. The support handle or arm 40 is pivotally and swingably connected to the main handle 11. The support arm 40 is mounted between a pair of pivot mounts 41 and 42 integrally extending from respective plates 19 and 20. A connector pin 43 is received in apertures in pivot mounts 41 and 42 and support arm 40.

The support arm 40 has a front end 44 having an abutment plate 45. The abutment plate 45 has a lateral slot 46 formed therein for receiving the free end 27 of the strap 28. The abutment plate 45 abuts a face 47 of a locking collar 48 of the strap 28. The locking collar 48 permits the strap 27 to freely slide through it in one direction, but locks onto the strap and prevents sliding of the strap in the other direction. A cut off blade receiving stop 49 extends outwardly from the abutment plate 45 and toward the lateral slot 46. A pair of opposing parallel plates 50 and 51, and the integrally connected abutment plate 45 form a cavity 52 in the support arm 40.

A cut off blade 53 slides in the cavity 52 of the support arm 40. A cutting arm 54 having a cutting edge 55 slides against an inside face 56 of the abutment plate 45 and between the plate 45 and a spring pin 57 which is mounted between the opposing plates 50 and 51. An outwardly projecting blade arm 58 having a hook end 59 extends from the support arm 40 through a space 60 formed between an abutment plate 45 and an extension blade support plate 61 of the support arm 40 to the front end 12 of the main handle 11. The hook end 59 is hooked to an extending end 62 of an extension spring or resetting means 63 mounted in cavity 25 of the main handle 11. A fixed end 64 of the spring 63 is hooked to a cut away extending section 65 of the rear end 13 of the main handle 11. The extension spring 63 continuously urges blade arm 54 and cutting edge 55 away from slot 46 and toward connector pin 43.

Figure 3:
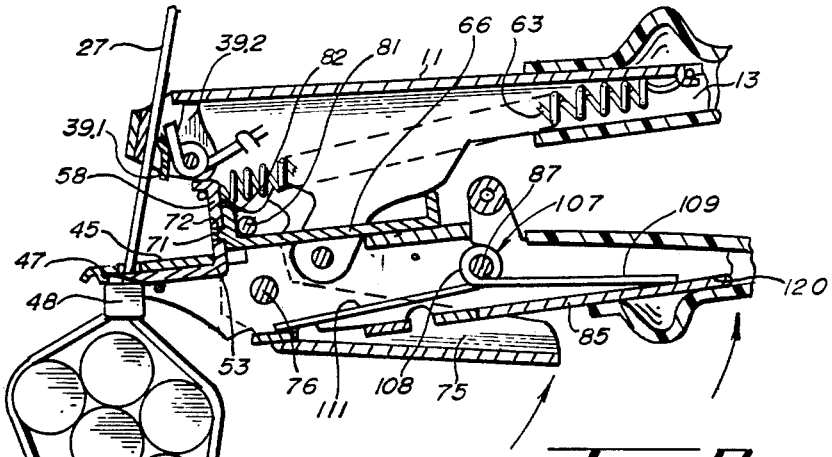
FIG. 3 shows the section view of FIG. 2 with a cut off lever propelling a blade to cut the strap.

A blade extension 66 having a pressing end 67 and a pressed end 68 extends from blade arm 58 to a spacer 69 mounted on a spring pin 70. As shown in FIG. 3, the pressing end 67 has a frontwardly projecting nub 71 which extends into and cooperates with an aperture 72 formed in the blade arm 58. A sliding face 73 of the blade extension 66 bears against an outside face 74 of the extension blade support plate 61.

As shown in FIGS. 1, 2, 3, and 7, a manually operated cut off lever 75 is pivotally and swingably connected to the support arm 40 by a removable connector pin 76. The cut off lever 75 is somewhat L-shaped, having a handle 77 and a pressure bearing arm 78 formed by a pair of opposing plates 79 and 80 extending over the plates 19 and 20 and 50 and 51 of the respective main handle 11 and support arm 40. The handle 77 is formed by a pair of opposing parallel plates 79.1 and 80.1 and an integrally connected side plate 80.2. A removable pressure bearing pin 81 is affixed in apertures in the plates 79 and 80 of the cut off lever 75 and brings pressure to bear on a pressure receiving face 82 of the pressing end 67 of the blade extension 66. The cut off lever 75 slides the blade extension 66 against the blade 53 which cuts the free end 27 of the strap 28. The blade 53 slides to an extended position where the cutting edge 55 contacts the stop 49 or a front face 83 of the blade arm 58 contacts a rear edge 84 of the abutment plate 45.

A front end 85.1 of the tensioning handle 85 is tiltably connected to a rear end 86 of the support arm 40 by a releasable connector pin 87 and a ball or quick release operating detent means 88. As shown in FIGS. 1, 2, 5 and 6, the ball detent means 88 includes a pair of break away flat springs 89 and 90 having a pair of respective front break away ends 91 and 92 and a pair of respective rear affixed ends 93 and 94. The rear ends 93 and 94 have apertures formed therein for receiving the connector pin 87. The springs 89 and 90 taper from the rear ends 93 and 94 to the front ends 91 and 92. The springs 89 and 90 also extend outwardly from the rear ends 93 and 94 to the front ends 91 and 92 and away from a pair of opposing parallel plates 95 and 96 of the tensioning handle 85 which lie inwardly of the springs 89 and 90. Front ends 95.1, 95.2 of the parallel plates 95 and 96 are integrally connected by a supporting saddle 96.2 extending therebetween.

The front break away ends 91 and 92 of the break away springs 89 and 90 include a pair of holes or slots 97 and 98. The front ends 91 and 92 receive a pair of respective balls or ball bearings 99 and 100 in the holes 91, 92 and retain the ball bearings 99, 100 in a pair of respective apertures 101 and 102 formed in a pair of respective front ends 103 and 104 of the opposing plates 95 and 96 of the tensioning handle 85. The diameters of apertures 101 and 102 are slightly larger than the diameters of their respective balls 99 and 100. The front break away ends 91 and 92 also releasably retain and releasably depress the balls 99 and 100 in a pair of respective ball seating and aligning apertures 105 and 106 formed in the rear end 86 of the support arm 40. Each aperture 105 and 106 has a diameter less than the diameter of its respective ball 99 and 100. The ball detent means 88 holds the tensioning handle 85 in a fixed orientation with the support arm 40 when the balls 99 and 100 are aligned with and seated in the ball seating apertures 105 and 106. The springs 89 and 90 exert a predetermined inward pressure on the balls 99 and 100. The pressure on the balls 99 and 100 is increased by inserting a washer 106.1 between the face of connector pin 87 and the face of the plates 95,96 of the tensioning handle 85. The greater the number of washers placed between the faces of the pin 87 and the plates 95, 96, the greater the force needed to break away the tensioning handle 85 from the support arm 40.

A torsion spring or resetting or biasing means 107 is disposed in the support arm 40 and the tensioning handle 85. A torsion coil 108 of the spring 107 is mounted about connector pin 87. A tensioning handle end 109 of torsion spring 107 lies in the tensioning handle 85 and bears outwardly against a wall 110 of the handle 85. A support arm end 111 of torsion spring 107 lies in the support arm 40 and bears outwardly against a wall 112 of the support arm 40.

The tensioning handle 85 includes an integral extension blade ear 116 extending inwardly from the front end 85.1 of the tensioning handle 85. A first plate 117 of the ear 116 extends inwardly from plate 95 of the handle 85. A second plate 118 of the ear 116 extends inwardly from the bottom plate 96 of the handle 85. The plates 117 and 118 of the ear 116 form apertures for receiving the spring pin 70 on which a spacer 69 is mounted. The spacer 69 bears against the pressed end 68 of the blade extension 66. The spacer 69 is disposed between the plates 117 and 118.

Each plate 95 and 96 of the tensioning handle 85 tapers away from the rear end 86 of the support arm 40 and curves somewhat outwardly from the support arm 40. Tensioning handle 85 includes a rubber like or plastic like grip 119 which covers a rear end 120 and extends therefrom to the ear 116. Grip 119 has an extrusion or bump 121 to assist in manual gripping of tensioning handle 85.

In operation, the strap 28 is wrapped around a bundle 121 and the free end 27 of the strap 28 is inserted in and manually pulled through the locking collar 48 until loose slack is taken up in the strap 28. The free end 27 is then inserted in the lateral slot 46 of the support arm 40 and the aligned lateral slot 26 of the main handle 11. As free end 27 is fed further into the main handle 11 the ridge face 33 of the free end 27 slides against plate 23 and the smooth face 33.1 slides against the tooth 32 of the gripper 30. The free end 27 of the strap 28 continues to be fed or pulled through the support arm 40 and main handle 11 until the face 47 of the locking collar 48 bears against the abutment plate 45 of the support arm 40.

The rear end 13 of the main handle 11 and the rear end 120 of the tensioning handle 85 are then subsequently squeezed together manually to tighten the strap 28 around the bundle 121 to a predetermined tension. As the rear ends 13 and 120 are drawn together and pivot about connector pin 43, the front end 12 of the main handle 11 and the front end 44 of the support arm 40 are drawn apart. As the front ends 12 and 44 are drawn apart, the tooth 32 of the gripper 30 bites into the smooth face 33.1 of the free end 27 and draws or pulls the free end 27 further through the locking collar 48 to tighten the strap 28 around the bundle 121. The extension spring 63 is extended as the front ends 12 and 44 are drawn apart.

As the rear ends 13 and 120 are released from being manually squeezed together, the extension spring 63 urges the front ends 12 and 44 back to their original or rest positions so that the inside face 56 of the abutment plate 45 of the front end 44 abuts the front end 39.1 of the gripper 30 and releases the tooth 32 from a biting engagement with the smooth face 33.1 of the strap end 27. As the front ends 12 and 44 return to their rest positions and the tooth 32 releases the strap end 27, the front ends 12 and 44 are slid further along the strap end 27 so that the face 47 of the locking collar 48 is again brought to bear against the abutment plate 45 of the support arm 40. Subsequently, the rear ends 13 and 120 are again manually squeezed so that the tooth 32 again bites into the strap end 27 to draw or pull the free end 27 through the locking collar 48 to further tighten the strap 28 around the bundle 121. The handles 11 and 85 may be squeezed and released a number of times before the strap 28 is tightened sufficiently.

Figure 5:
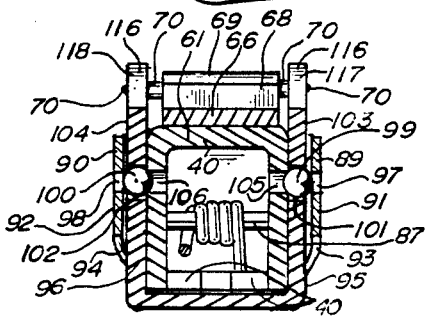
FIG. 5 shows a detail section view of a ball detent means at lines 5—5 of FIG. 2 that releasably connects the tensioning handle to a support arm.
Figure 6:
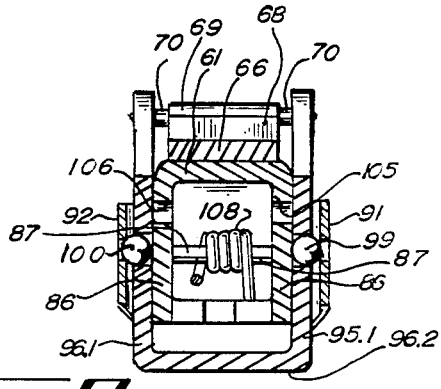
FIG. 6 shows the ball detent means of FIG. 5 with balls of the ball detent means displaced from ball aligning apertures in the support arm and allowing the tensioning handle to articulate about the support arm.

As shown in FIGS. 4, 5, and 6, when the strap 28 reaches a predetermined tension, the tensioning handle 85 suddenly articulates about and is released from a fixed relationship with the rear end 86 of the support arm 40. The balls 99 and 100 move from a rest position in their respective ball seating apertures 105 and 106 to an operating position out of the apertures 105 and 106 and onto the exterior of the rear end 86 of the support arm 40. The balls 105 and 106 are retained in their respective apertures 101 and 102 of the tensioning handle 85 by their respective break away springs 89 and 90 as the tensioning handle 85 articulates about the support arm 40.

As the tensioning handle 85 articulates or snaps or pivots about connector pin 87, the extension blade ear 116 suddenly pivots inwardly to propel the spacer 69 against the pressed end 68 of the blade extension 66. The pressing end 67 of the blade extension 66 thus propels the blade arm 58 and cut off blade 53 forwardly to cut off the free end 27 of the strap 28. The free end 27 is sheared between the abutment plate 45 of the support arm 40 and the face 47 of the locking collar 48.

As the tensioning handle 85 articulates, a greater pressure is brought to bear by torsion spring ends 109, 111 on wall 110 of the tensioning handle 85 and wall 111 of the tensioning handle 85 and wall 111 of the support arm 40. After the free end 27 is cut and manual gripping pressure is released, the torsion spring ends 109, 111 return or reset the tensioning handle 85 to a fixed relationship with the support arm 40. The balls 99 and 100 are thus returned to their respective ball seating apertures 105 and 106. Cut off blade 53 and blade extension 66 are returned or reset to their respective rest positions by the extension spring 63 which had been extended as the cut off blade 53 slid forwardly to cut off the free end 27. The tool 10 is then available for use on another strap. The tension at which the tool !0 cuts the free end 27 may be determined by the inward pressure applied to the balls 99 and 100 by the break away springs 89 and 90.

As shown in FIG. 3, the cut off lever 75 operates the cut off blade 53 independently of the tensioning handle 85. To cut off the free end 27, the lever 75 is swung toward the main handle 11 and pivots on connector pin 76 about support arm 40. The pressure bearing pin 81 of the lever 75 brings pressure to bear on the receiving face 82 of the blade extension 66. The blade extension 66 thus propels the cut off blade 53 to shear the free end 27 of the strap 28 between the abutment plate 45 and the face 47 of the locking collar 48. As the manual gripping pressure is released, the extension spring 63, which had been extended to an operating position by protruding blade arm 58, urges the cut off blade 53, the blade extension 66, and the cut off lever 75 to their rest positions. The tool 10 is then available for use on another strap. It should be noted that the cut off lever 75 is operational at all times, even when the main handle 11, support arm 40, and tensioning handle 85 are disposed in their rest positions.

An alternate resetting means is shown in FIG. 7. A pair of leaf springs or resetting or biasing means 130 and 131 is disposed in the support arm 40 and the tensioning handle 85. The springs 130 and 131 lie adjacent each other along substantially their whole length and spring 131 lies outwardly of spring 130. A tensioning handle end 132 of leaf spring 131 lies in the tensioning handle 85 and bears outwardly against the wall 110 of the handle 85. A support arm end 133 of leaf spring 131 lies in the support art 40 and bears outwardly against the wall 112 of the support arm 40. The leaf spring 130 forms a depression 134 which bears inwardly against pin 87. The leaf springs 130 and 131 include a pair of inwardly curved middle sections 135 and 136 disposed between end 132 and pin 87 and end 133 and pin 87, respectively.

That which is claimed:

1. A tensioning and cut off tool for applying a strap to a bundle and wherein the strap has a locking collar and a free end, comprising a pair of swingable handles pivotally connected together, the handles having rear ends to be manually gripped and swung, and also having front ends with strap engaging means for gripping and tensioning the strap as the handles are swung toward each other, a cut off blade movably mounted on a portion of one of the handles to move against the strap for cutting the strap, one of the handles having a quick, release operating mechanism connected with the blade for moving the blade against the strap when released, said operating mechanism releasing in response to a predetermined force manually applied to the handles as tension is applied to the strap, and said mechanism operating the blade when released to move the blade with a snap action to suddenly cut the strap, and one of said handles including a support arm defining said blade mounting portion, said quick release operating mechanism including a pressure lever tiltably connected to the support arm, said pressure lever tilting on the support arm to produce movement of the blade for cutting the strap and the mechanism also including a pressure responsive releasable retainer normally retaining the pressure lever against tilting with respect to the support arm and releasing the lever for tilting when a predetermined pressure is applied on the lever causing swinging of the handle and resulting in predetermined pressure on the strap.

2. A tensioning and cut off tool according to claim 1, wherein the releasable retainer comprises a spring pressed ball detent means connecting the support arm and pressure lever for releasably retaining the support arm and the pressure lever in the fixed relationship.

3. A tensioning and cut off tool according to claim 2, and wherein the releasable retainer includes relatively moving portions of the support arm and pressure lever, one of said moving portions having an indented seat, the other of said moving portions having a confining aperture aligned with the seat, a ball in the aperture and bearing on the seat, and a spring anchored on one of the portions and pressing the ball against the seat.

4. A tensioning and cut off tool for applying a strap having a locking collar and a free end to a handle, comprising a pair of swingable handles pivotally connected together, the handles having rear ends to be manually gripped and swung, and also having a front ends with strap engaging means for gripping and tensioning the strap as the handles are swung toward each other, a cut off blade movably mounted on a portion of one of the handles to move against the strap for cutting the strap, one of the handles having a quick release operating mechanism connected with the blade for moving the blade against the strap when released, said operating mechanism releasing in response to a predetermined force manually applied to the strap, and said mechanism operating the blade when released to move the blade with a snap action to suddenly cut the strap, one of the handles having means for resetting the operating mechanism to a fixed position from an operating position, the resetting means also returning the cut off blade to a rest position from an extended position, and one of the handles being articulated and said front and rear ends being tiltably connected together for tilting between a rest position and an operating position, the tilting of said front and rear ends into operating position with respect to each other causing operation of said mechanism to move the blade for cutting the strap, said resetting means including a spring for returning the blade away from the strap when the front and rear ends of said one handle are returned to rest position.

5. A tensioning and cut off tool according to claim 4, wherein said resetting means also includes spring means for returning the blade away from the strap and returning the front and rear portions of said one handle to rest position.

6. A tensioning and cut off tool according to claim 5, wherein said spring means includes a torsion spring applying tilting pressure onto the front and rear ends of said one handle.

7. A tensioning and cut off tool according to claim 5, wherein said spring means includes a leaf spring applying tilting pressure onto the front and rear ends of said one handle.

8. A tensioning and cut oof tool for applying a strap having a locking collar and a free end to a bundle, comprising, a pair of swingable handles pivotally connected together, the handles having rear ends to be manually gripped and swung, and also having front ends with strap engaging means for gripping and tensioning the strap as the handles are swung toward each other, a cut off blade movably mounted on a portion of one of the handles to move against the strap for cutting the strap, one of the handles having a quick release operating mechanism connected with the blade for moving the blade against the strap when released, said operating mechanism releasing in response to a predetermined force manually applied to the handles as tension is applied to the strap, and said mechanism operating the blade when released to move the blade with a snap action to suddenly cut the strap, and a manual operating mechanism mounted on one of the handles for operating the cut off blade independently of the quick release operating mechanism.

9. A tensioning and cut off tool according to claim 8 wherein the manual operating mechanism comprises a cut off lever pivotally mounted on one of the handles and having a pressure bearing means for bringing pressure to bear on the cut off blade to cut the strap.

10. A tensioning and cut off tool according to claim 8, wherein one of said handles includes a support arm defining said blade mounting portion, said quick release operating mechanism includes a pressure lever tiltably connected to the support pressure lever, said pressure lever tilting on the support arm to produce movement of the blade for cutting the strap and the mechanism also including a pressure responsive releasable retainer normally retaining the pressure lever against tilting with respect to the support arm and releasing the lever for tilting when a predetermined pressure is applied on the lever causing swinging of the handle and resulting in predetermined pressure on the strap.

11. A tensioning and cut off tool according to claim 10, wherein the releasable retainer comprises a spring pressed ball detent means connecting the support arm and pressure lever for releasably retaining the support arm and the pressure lever in the fixed relationship.

12. A tensioning and cut off tool according to claim 11, and wherein the releasable retainer includes relatively moving portions of the support arm and pressure lever, one of said moving portions having an indented seat, the other of said moving portions having a confining aperture aligned with the set, a ball in the aperture and bearing on the seat, and a spring anchored on one of the portions and pressing the ball against the seat.

13. A tensioning and cut off tool according to claim 8, and wherein one of the handles includes means for resetting the operating mechanism to a fixed portion from an operating position, the resetting means also returning the cut off blade to a reset position from an extended position.

* * * * *